US009630736B2

(12) United States Patent
Oliveira

(10) Patent No.: US 9,630,736 B2
(45) Date of Patent: Apr. 25, 2017

(54) CARTON WITH REINFORCEMENT FEATURES

(71) Applicant: Graphic Packaging International, Inc., Atlanta, GA (US)

(72) Inventor: Steven M. Oliveira, Canton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/940,695

(22) Filed: Nov. 13, 2015

(65) Prior Publication Data

US 2016/0137336 A1 May 19, 2016

Related U.S. Application Data

(60) Provisional application No. 62/123,443, filed on Nov. 17, 2014.

(51) Int. Cl.

| | |
|---|---|
| ***B65D 5/02*** | (2006.01) |
| ***B65D 5/54*** | (2006.01) |
| ***B31B 1/78*** | (2006.01) |
| ***B65D 5/42*** | (2006.01) |
| ***B65D 5/06*** | (2006.01) |
| ***B65D 5/10*** | (2006.01) |
| ***B65D 5/468*** | (2006.01) |

(52) U.S. Cl.

CPC ..... *B65D 5/0254* (2013.01); *B65D 5/06* (2013.01); *B65D 5/10* (2013.01); *B65D 5/4608* (2013.01); *B65D 5/544* (2013.01)

(58) Field of Classification Search

CPC ..... B65D 5/0254; B65D 5/54; B65D 5/4266; B65D 5/10; B65D 2571/00444; B65D 5/2033; B65D 71/32; B31B 1/78

USPC ..... 229/155, 109, 117.13, 185, 183; 206/427; 493/183

See application file for complete search history.

(56) References Cited

U.S. PATENT DOCUMENTS

| | | | |
|---|---|---|---|
| 499,655 | A | 6/1893 | Clark |
| 642,121 | A | 1/1900 | Hildreth |
| 1,503,161 | A | 7/1924 | Hornecker |
| 1,634,073 | A | 6/1927 | Labombarde |
| 1,656,919 | A | 1/1928 | Marsh |
| 1,762,704 | A | 6/1930 | Smith |
| 1,901,483 | A | 3/1933 | Ware, Jr. |

(Continued)

FOREIGN PATENT DOCUMENTS

| | | |
|---|---|---|
| DE | 2 320 190 | 11/1973 |
| DE | 36 27 019 | 2/1988 |

(Continued)

OTHER PUBLICATIONS

International Search Report and Written Opinion for PCT/US2015/060572 dated Feb. 19, 2016.

(Continued)

*Primary Examiner* — Christopher Demeree
(74) *Attorney, Agent, or Firm* — Womble Carlyle Sandridge & Rice, LLP

(57) ABSTRACT

A carton for holding a plurality of articles. The carton includes at least one top panel, a first side panel, a second side panel, and a bottom panel. A plurality of end flaps is foldably connected to a respective panel to close an end of the carton. The carton includes reinforcement features at the end of the carton to increase the strength of the carton.

45 Claims, 15 Drawing Sheets

(56) References Cited

U.S. PATENT DOCUMENTS

| | | | |
|---|---|---|---|
| 1,912,698 | A | 6/1933 | Forsman |
| 1,925,102 | A | 9/1933 | Levkoff |
| 1,951,408 | A | 3/1934 | Haven |
| 1,971,863 | A | 8/1934 | Lupton |
| 2,027,079 | A | 1/1936 | Weiss |
| 2,122,654 | A | 7/1938 | Nickerson |
| 2,141,743 | A | 12/1938 | Ethridge |
| 2,145,430 | A | 1/1939 | New |
| 2,152,079 | A | 3/1939 | Mott |
| 2,196,243 | A | 4/1940 | Bensel |
| 2,196,502 | A | 4/1940 | Kells |
| 2,222,211 | A | 11/1940 | Arneson |
| 2,290,971 | A | 7/1942 | King |
| 2,308,050 | A | 1/1943 | Burr |
| 2,330,294 | A | 9/1943 | Leavitt et al. |
| 2,383,853 | A | 8/1945 | Guyer |
| 2,386,905 | A | 10/1945 | Meitzen |
| 2,407,802 | A | 9/1946 | Stotter |
| 2,416,332 | A | 2/1947 | Lehman |
| 2,460,108 | A | 1/1949 | Smith et al. |
| 2,611,528 | A | 9/1952 | Vadner |
| 2,643,589 | A | 6/1953 | Weiss |
| 2,645,405 | A | 7/1953 | Dorfman |
| 2,648,484 | A | 8/1953 | Belsinger |
| 2,665,050 | A | 1/1954 | Baumann |
| 2,679,349 | A | 5/1954 | Mullinix |
| 2,702,155 | A | 2/1955 | Baumann |
| 2,710,134 | A | 6/1955 | Schroeder et al. |
| 2,791,362 | A | 5/1957 | Nute |
| 2,811,298 | A | 10/1957 | Jones |
| 2,875,938 | A | 3/1959 | Bramhill |
| 2,900,123 | A | 8/1959 | Drnec et al. |
| 2,933,228 | A | 4/1960 | Guyer |
| 2,954,913 | A | 10/1960 | Rossman |
| 2,955,739 | A | 10/1960 | Collura |
| 2,967,610 | A | 1/1961 | Ebert |
| 2,990,999 | A | 7/1961 | George et al. |
| 2,993,619 | A | 7/1961 | Arneson |
| 3,002,613 | A | 10/1961 | Merkel et al. |
| 3,003,676 | A | 10/1961 | De Nola |
| 3,055,569 | A | 9/1962 | Layne, Sr. |
| 3,069,065 | A | 12/1962 | Bebout et al. |
| 3,090,483 | A | 5/1963 | Altree et al. |
| 3,092,301 | A | 6/1963 | Selle |
| 3,094,266 | A | 6/1963 | Hoff |
| 3,094,268 | A | 6/1963 | Swanson et al. |
| 3,095,137 | A | 6/1963 | Reynolds |
| 3,112,856 | A | 12/1963 | MacIntosh et al. |
| 3,157,342 | A | 11/1964 | Grady |
| 3,158,312 | A | 11/1964 | Simkins |
| 3,173,596 | A | 3/1965 | Aust et al. |
| 3,199,763 | A | 8/1965 | Anderson |
| 3,265,283 | A | 8/1966 | Farquhar |
| 3,276,665 | A | 10/1966 | Rasmussen |
| 3,280,968 | A | 10/1966 | Craine |
| 3,348,758 | A | 10/1967 | Ellis |
| 3,434,648 | A | 3/1969 | Du Barry, Jr. |
| 3,653,495 | A | 4/1972 | Gray |
| 3,677,458 | A | 7/1972 | Gosling |
| 3,756,499 | A | 9/1973 | Giebel et al. |
| 3,759,378 | A | 9/1973 | Werth |
| 3,786,914 | A | 1/1974 | Beutler |
| 3,884,348 | A | 5/1975 | Ross |
| 4,005,815 | A | 2/1977 | Nerenberg et al. |
| 4,008,849 | A | 2/1977 | Baber |
| 4,029,207 | A | 6/1977 | Gordon |
| 4,058,250 | A | 11/1977 | Akkerman |
| 4,059,220 | A | 11/1977 | Lorenz |
| 4,101,048 | A | 7/1978 | Rieben et al. |
| 4,101,052 | A | 7/1978 | Dove |
| 4,113,100 | A | 9/1978 | Soja et al. |
| 4,165,031 | A | 8/1979 | Osborne |
| 4,318,474 | A | 3/1982 | Hasegawa |
| 4,498,619 | A | 2/1985 | Roccaforte |
| 4,519,538 | A | 5/1985 | Omichi |
| 4,538,759 | A | 9/1985 | Dutcher |
| 4,558,785 | A | 12/1985 | Gordon |
| 4,586,643 | A | 5/1986 | Halabisky et al. |
| 4,621,766 | A | 11/1986 | McClure |
| 4,679,726 | A | 7/1987 | Oliff |
| 4,742,917 | A | 5/1988 | Bornwasser et al. |
| 4,760,952 | A | 8/1988 | Wachter et al. |
| 4,773,541 | A | 9/1988 | Riddell |
| 4,778,057 | A | 10/1988 | Allen et al. |
| 4,784,316 | A | 11/1988 | Crouch |
| 4,792,084 | A | 12/1988 | Dreeszen |
| 4,815,609 | A | 3/1989 | Kiedaisch |
| 4,836,375 | A | 6/1989 | Schuster et al. |
| 4,865,187 | A | 9/1989 | Zulauf et al. |
| 4,886,160 | A | 12/1989 | Kilgerman |
| 4,901,911 | A | 2/1990 | Drexhage |
| 4,919,269 | A | 4/1990 | Wright et al. |
| 4,966,324 | A | 10/1990 | Steel |
| 4,981,254 | A | 1/1991 | Depper |
| 5,012,929 | A | 5/1991 | Roosa |
| 5,072,876 | A | 12/1991 | Wilson |
| 5,119,985 | A | 6/1992 | Dawson et al. |
| 5,181,650 | A | 1/1993 | Hollander et al. |
| 5,197,598 | A | 3/1993 | Stout et al. |
| 5,222,660 | A | 6/1993 | Koss |
| 5,259,550 | A | 11/1993 | Kuchenbecker |
| 5,328,091 | A | 7/1994 | Koss |
| 5,350,109 | A | 9/1994 | Brown et al. |
| 5,472,136 | A | 12/1995 | Roccaforte |
| 5,560,539 | A | 10/1996 | Baxter |
| 5,588,585 | A | 12/1996 | McClure |
| 5,611,425 | A | 3/1997 | Holley, Jr. |
| 5,699,957 | A | 12/1997 | Blin et al. |
| 5,783,030 | A | 7/1998 | Walsh |
| 5,794,778 | A | 8/1998 | Harris |
| 5,842,576 | A | 12/1998 | Snow |
| 5,857,570 | A | 1/1999 | Brown |
| 5,881,884 | A | 3/1999 | Podosek |
| D412,114 | S | 7/1999 | Hansen |
| 5,921,398 | A | 7/1999 | Carroll |
| 5,927,498 | A | 7/1999 | Saam |
| 5,979,749 | A | 11/1999 | Bozich |
| D419,440 | S | 1/2000 | Hansen |
| 6,015,084 | A | 1/2000 | Mathieu et al. |
| 6,019,276 | A | 2/2000 | Auclair |
| 6,027,017 | A | 2/2000 | Kuhn et al. |
| 6,065,590 | A | 5/2000 | Spivey |
| 6,112,977 | A | 9/2000 | Sutherland et al. |
| 6,129,211 | A | 10/2000 | Prakken et al. |
| 6,131,803 | A | 10/2000 | Oliff et al. |
| 6,135,289 | A | 10/2000 | Miller |
| 6,158,579 | A | 12/2000 | Rosenbaum |
| 6,170,741 | B1 | 1/2001 | Skolik et al. |
| 6,250,542 | B1 | 6/2001 | Negelen |
| 6,273,330 | B1 | 8/2001 | Oliff et al. |
| 6,386,369 | B2 | 5/2002 | Yuhas et al. |
| 6,419,152 | B1 | 7/2002 | Tokarski |
| 6,435,351 | B1 | 8/2002 | Gibb |
| 6,478,159 | B1 | 11/2002 | Taylor et al. |
| 6,510,982 | B2 | 1/2003 | White |
| 6,523,692 | B2 | 2/2003 | Gregory |
| 6,595,411 | B2 | 7/2003 | McClure |
| 6,631,803 | B2 | 10/2003 | Rhodes et al. |
| 6,729,475 | B2 | 5/2004 | Yuhas et al. |
| 6,766,940 | B2 | 7/2004 | Negelen |
| 6,848,573 | B2 | 2/2005 | Gould et al. |
| 6,854,639 | B2 | 2/2005 | Walsh |
| 6,869,009 | B2 | 3/2005 | Sutherland et al. |
| 6,905,027 | B2 | 6/2005 | Galter |
| 6,913,189 | B2 | 7/2005 | Oliff et al. |
| 6,918,487 | B2 | 7/2005 | Harrelson |
| 6,968,992 | B2 | 11/2005 | Schuster |
| 7,021,468 | B2 | 4/2006 | Cargile, Jr. |
| 7,201,714 | B2 | 4/2007 | Zoeckler et al. |
| 7,234,596 | B2 | 6/2007 | Lebras |
| 7,337,909 | B1 | 3/2008 | Morgan |
| 7,614,497 | B2 | 11/2009 | Spivey, Sr. |
| 7,703,666 | B2 | 4/2010 | Hand et al. |
| 7,743,970 | B2 | 6/2010 | Bates et al. |

(56) References Cited

U.S. PATENT DOCUMENTS

| | | | | |
|---|---|---|---|---|
| 7,748,603 | B2 | 7/2010 | Fogle et al. | |
| 7,757,933 | B2 | 7/2010 | Dunn | |
| 7,775,418 | B2 | 8/2010 | Walling | |
| 7,780,003 | B2 | 8/2010 | Harrelson | |
| 7,780,067 | B2 | 8/2010 | Holley, Jr. | |
| 7,806,314 | B2 | 10/2010 | Sutherland | |
| 7,815,097 | B2 | 10/2010 | Fogle et al. | |
| 7,832,622 | B2 | 11/2010 | Spivey, Sr. | |
| 7,900,816 | B2 | 3/2011 | Kastanek et al. | |
| 7,959,062 | B2 | 6/2011 | Auclair | |
| 7,984,843 | B2 | 7/2011 | Cooper et al. | |
| 7,998,047 | B2 | 8/2011 | Spivey, Sr. et al. | |
| 8,070,052 | B2 | 12/2011 | Spivey, Sr. et al. | |
| 8,191,761 | B2 | 6/2012 | Brand | |
| 8,216,118 | B2 | 7/2012 | Dunn | |
| 8,231,513 | B2 | 7/2012 | Smalley | |
| 8,302,811 | B2 | 11/2012 | Spivey | |
| 8,453,918 | B2 | 6/2013 | Hsiao et al. | |
| 8,584,926 | B2 * | 11/2013 | Bull | B65D 71/36 206/739 |
| 8,602,292 | B2 | 12/2013 | Brand | |
| 8,622,280 | B2 | 1/2014 | Coltri-Johnson et al. | |
| 8,783,550 | B2 | 7/2014 | Schuster | |
| 8,827,144 | B2 | 9/2014 | Gomes et al. | |
| 8,967,380 | B2 | 3/2015 | Moncrief et al. | |
| 9,033,210 | B2 | 5/2015 | Kastanek | |
| 9,073,680 | B2 | 7/2015 | Kastanek | |
| 2001/0048022 | A1 | 12/2001 | Zoeckler | |
| 2002/0170845 | A1 | 11/2002 | Oliff | |
| 2003/0226879 | A1 | 12/2003 | Auclair et al. | |
| 2005/0087592 | A1 | 4/2005 | Schuster | |
| 2005/0092649 | A1 | 5/2005 | Ford et al. | |
| 2005/0167291 | A1 | 8/2005 | Sutherland | |
| 2005/0167292 | A1 | 8/2005 | Sutherland | |
| 2005/0189405 | A1 | 9/2005 | Gomes et al. | |
| 2005/0218203 | A1 | 10/2005 | Harrelson | |
| 2005/0263574 | A1 | 12/2005 | Schuster | |
| 2006/0081691 | A1 | 4/2006 | Smalley | |
| 2006/0169755 | A1 | 8/2006 | Spivey, Jr. | |
| 2006/0261138 | A1 | 11/2006 | Bates et al. | |
| 2006/0266815 | A1 | 11/2006 | Coltri-Johnson et al. | |
| 2006/0278689 | A1 | 12/2006 | Boshinski et al. | |
| 2006/0278691 | A1 | 12/2006 | Bezek | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2008/0110967 | A1 | 5/2008 | Walling | |
| 2008/0203143 | A1 | 8/2008 | Holley | |
| 2008/0265008 | A1 | 10/2008 | Holley | |
| 2009/0095799 | A1 | 4/2009 | Garner | |
| 2010/0025457 | A1 | 2/2010 | Cooper et al. | |
| 2011/0240725 | A1 | 10/2011 | Spivey | |
| 2011/0284624 | A1 | 11/2011 | DeBusk et al. | |
| 2012/0012600 | A1 | 1/2012 | Gonzalez | |
| 2012/0067755 | A1 | 3/2012 | Spivey, Sr. | |
| 2012/0091021 | A1 | 4/2012 | Smalley | |
| 2012/0152768 | A1 | 6/2012 | Cheema et al. | |

FOREIGN PATENT DOCUMENTS

| | | |
|---|---|---|
| DE | 298 17 195 | 11/1998 |
| DE | 202 16 854 | 1/2003 |
| EP | 0 133 595 | 2/1985 |
| EP | 0 704 386 | 4/1996 |
| EP | 0 870 688 | 10/1998 |
| EP | 1 852 359 | 11/2007 |
| FR | 1.379.931 | 12/1963 |
| FR | 2 882 032 | 8/2006 |
| GB | 1 218 016 | 1/1971 |
| JP | 11-301649 | 11/1999 |
| JP | 2000-006956 | 1/2000 |
| WO | WO 98/31593 | 7/1998 |
| WO | WO 99/28198 | 6/1999 |
| WO | WO 03/082686 | 10/2003 |
| WO | WO 2004/063031 | 7/2004 |
| WO | WO 2008/027954 | 3/2008 |

OTHER PUBLICATIONS

International Search Report and Written Opinion for PCT/US2015/060566 dated Feb. 22, 2016.

* cited by examiner

CARTON WITH REINFORCEMENT FEATURES

CROSS-REFERENCE TO RELATED APPLICATION

This application claims the benefit of U.S. Provisional Patent Application No. 62/123,443, filed Nov. 17, 2014.

INCORPORATION BY REFERENCE

The disclosure of U.S. Provisional Patent Application No. 62/123,443, which was filed on Nov. 17, 2014, is hereby incorporated by reference for all purposes as if presented herein in its entirely.

BACKGROUND OF THE DISCLOSURE

The present disclosure generally relates to cartons or carriers for holding beverage containers or other types of articles. More specifically, the present disclosure relates to cartons that include reinforcement features for strengthening the carton.

SUMMARY OF THE DISCLOSURE

In general, one aspect of the disclosure is directed to a carton for carrying a plurality of articles. The carton comprises at least one top panel, a first side panel, a second side panel, and a bottom panel. A plurality of end flaps is foldably connected to a respective panel to close an end of the carton. The carton includes reinforcement features at the end of the carton to increase the strength of the carton.

In another aspect, the present disclosure is generally directed to a carton for carrying a plurality of articles. The carton comprising a plurality of panels that extend at least partially around an interior of the carton. The plurality of panels comprising at least one top panel, a first side panel, a second side panel, and bottom panel. A plurality of end flaps are foldably connected to respective panels of the plurality of panels for closing an end of the carton. At least one end flap of the plurality of end flaps has reinforcement features for increasing the strength of the carton, the reinforcement features comprises a distal portion of the at least one end flap that is positioned between at least two articles of the plurality of articles.

In another aspect, the present disclosure is generally directed to a blank for forming a carton for carrying a plurality of articles. The blank comprises a plurality of panels comprising at least one top panel, a first side panel, a second side panel, and a bottom panel. A plurality of end flaps are foldably connected to a respective panel of the plurality of panels for closing an end of the carton formed from the blank. Wherein at least one end flap of the plurality of end flaps has reinforcement features for increasing the strength of the carton. The reinforcement features comprising a distal portion of the at least one end flap that is positioned between at least two articles of the plurality of articles when the carton is formed from the blank.

In another aspect, the present disclosure is generally directed to a method of forming a carton for carrying a plurality of articles. The method comprises obtaining a blank comprising a plurality of panels comprising at least one top panel, a first side panel, a second side panel, and bottom panel, a plurality of end flaps each foldably connected to a respective panel of the plurality of panels, wherein at least one end flap of the plurality of end flaps has reinforcement features for increasing the strength of the carton. The reinforcement features comprise a distal portion of the at least one end flap. The method comprises positioning the plurality of panels to form an interior of the carton, closing an end of the carton by at least partially overlapping the plurality of end flaps, and positioning the reinforcement features to increase the strength of the carton. The positioning the reinforcement features comprising positioning the distal portion between at least two articles of the plurality of articles.

Other aspects, features, and details of the present disclosure can be more completely understood by reference to the following detailed description of exemplary embodiments taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, pouches, bottles, cans, boxes, etc. The articles can be used for packaging food and beverage products, for example. The articles can be made from materials suitable in composition for packaging the particular food or beverage item, and the materials include, but are not limited to, flexible pouch material such as laminates including aluminum and synthetic polymer layers; flexible pouch material such as laminates including synthetic polymer layers; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes flexible pouches (e.g., juice pouches) as disposed within the carton embodiments. In this specification, the terms "lower," "bottom," "upper" and "top" indicate orientations determined in relation to fully erected and upright cartons.

Figure 1:
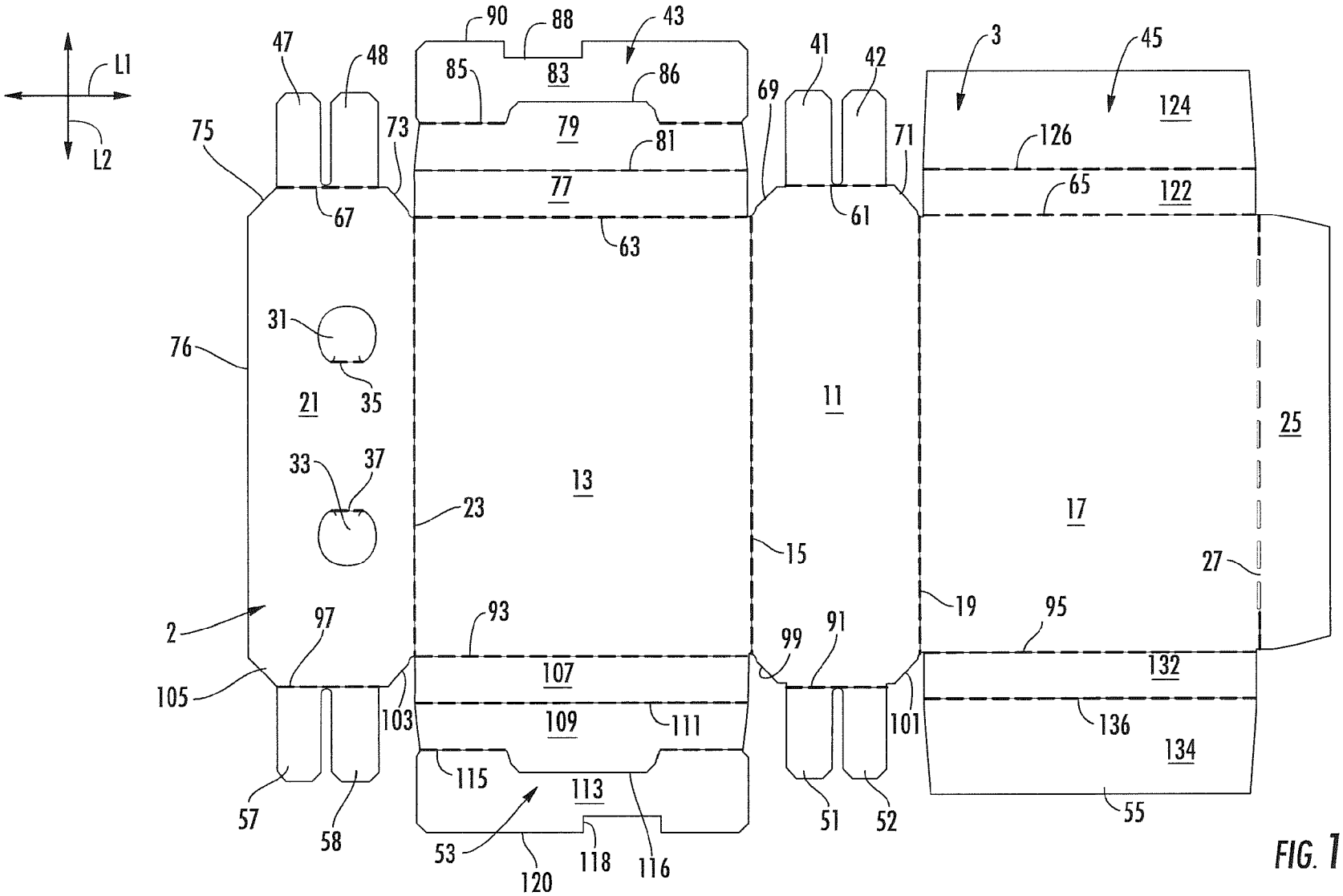
FIG. 1 is an exterior plan view of a carton blank used to form a carton in accordance with a first embodiment of the disclosure.
Figure 6:
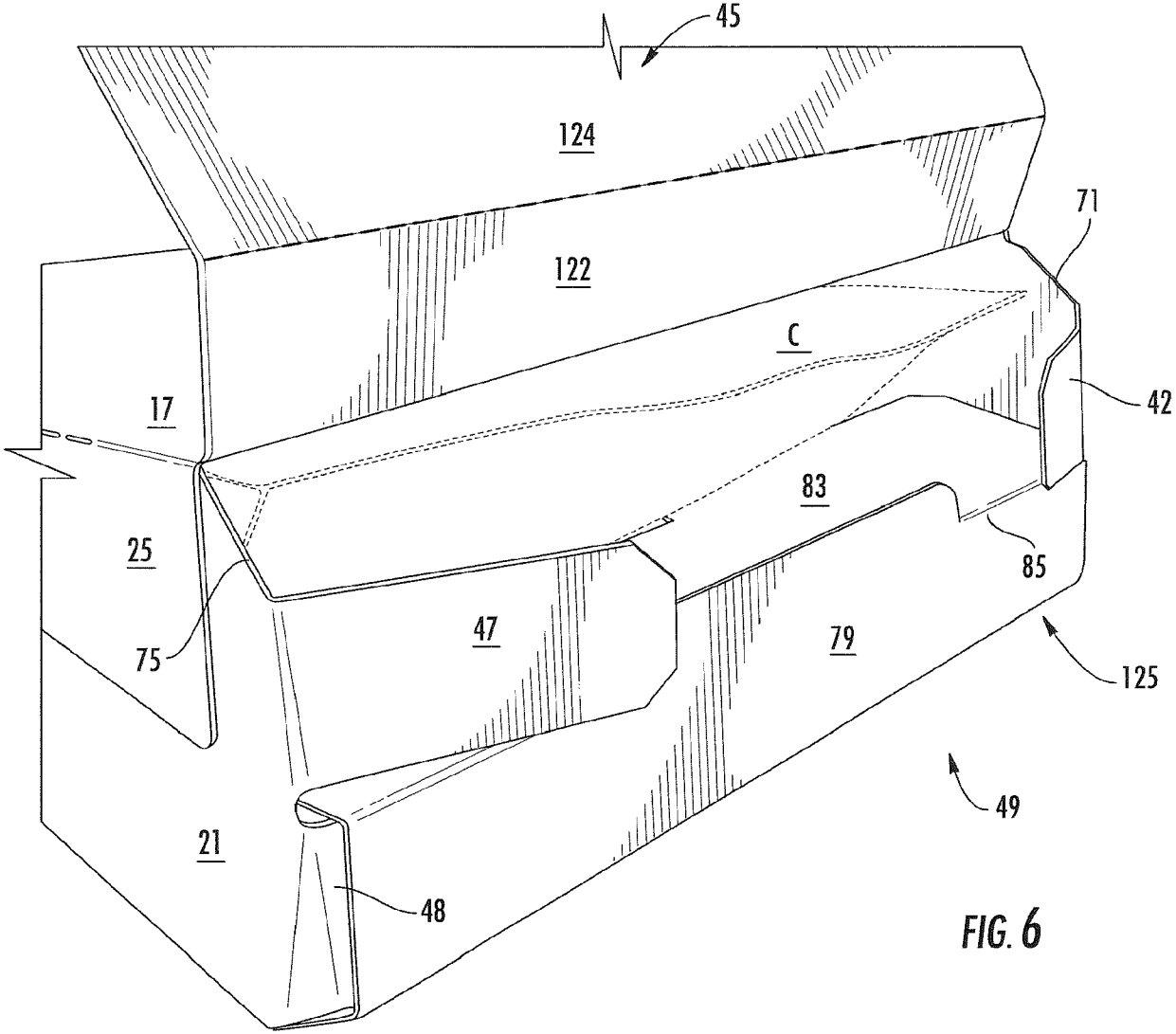
FIG. 6 is a close-up view of an end of the partially assembled carton having reinforcement features in accordance with the first embodiment of the disclosure.
Figure 7:
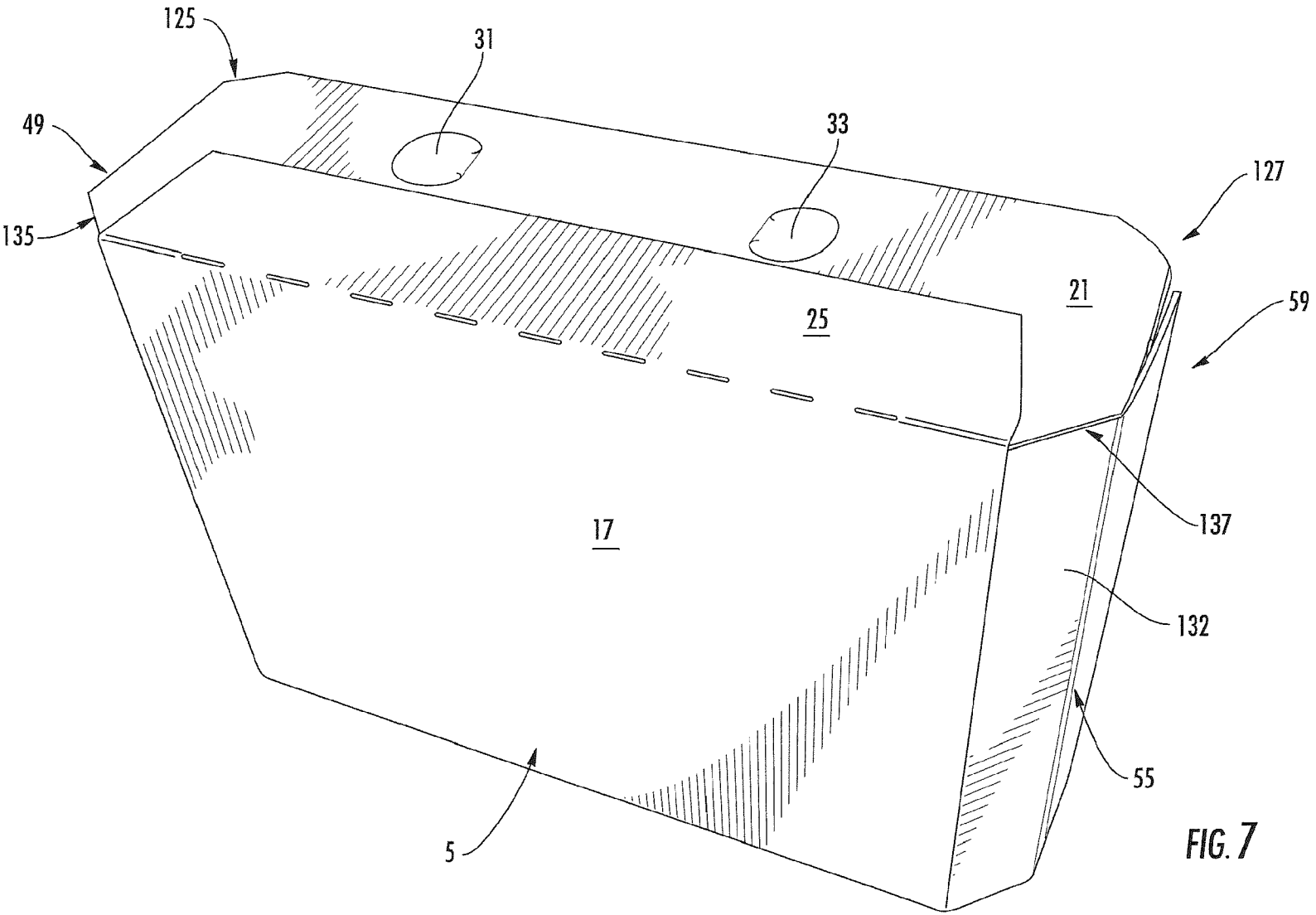
FIG. 7 is a perspective view of the assembled carton in accordance with the first embodiment of the disclosure.
Figure 8:
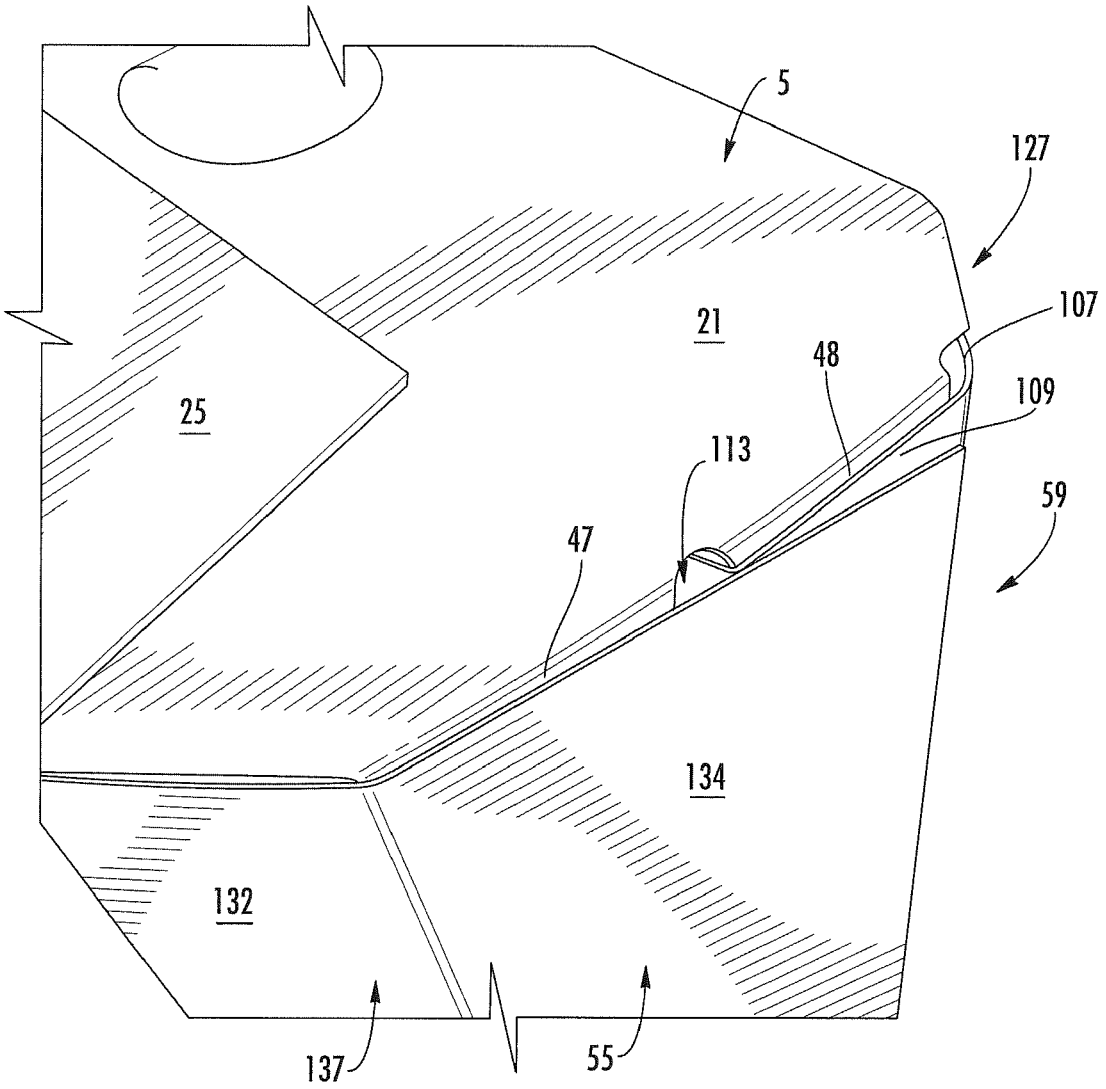
FIG. 8 is a close-up view of an end of the assembled carton having reinforcement features in accordance with the first embodiment of the disclosure.

FIG. 1 is a plan view of an exterior surface 2 of a blank 3, used to form a carton 5, shown in FIGS. 7-8, according to one embodiment of the disclosure. The carton 5 can be used to house a plurality of articles such as containers C (e.g., see exemplary containers C shown in FIGS. 3-6). In one embodiment, the containers C can be flexible pouches commonly referred to as juice pouches, although the containers can contain fluids other than juice. The containers C can be any suitable beverage container such as any shape, size, and type of containers or any other container containing products such as beverages or products other than beverages without departing from the disclosure.

In one embodiment, the blank 3 is sized to form a carton 5 that contains ten containers C in two layers with each layer having five containers (e.g., a 2×5 arrangement). But, it is understood that the blank 3 and/or carton 5 may be sized and shaped to hold containers C of a different or same quantity in a single layer or more than two layers and/or in different row/column arrangements (e.g., 1×6, 2×3, 2×4, 2×6, 2×4, 2×2, 2×6×2, 2×4×2, 2×9, etc.). In the illustrated embodiment, the carton 5 has reinforcement features for strengthening the carton to allow stacking of multiple cartons without failure (e.g., crushing) of the carton.

As shown in FIG. 1, the blank 3 has a longitudinal axis L1 and a lateral axis L2. In the illustrated embodiment, the blank 3 comprises a bottom panel 11 foldably connected to a first side panel 13 at a lateral fold line 15, a second side panel 17 foldably connected to the bottom panel at a lateral fold line 19, a first top panel 21 foldably connected to the first side panel 13 at a lateral fold line 23, and a second top panel 25 foldably connected to the second side panel 17 at a lateral fold line 27. In one embodiment, the first top panel 21 includes handle flaps 31, 33 respectively foldably connected to the first top panel at longitudinal fold lines 35, 37. The handle flaps 31, 33 could be otherwise shaped, arranged, configured, and/or omitted without departing from the disclosure.

In one embodiment, the panels 11, 13, 17, 21 have respective first end flaps 41, 42, 43, 45, 47, 48 at a first marginal portion of the blank 3 such that the first end flaps are foldably connected to respective panels to close a first end 49 of the carton 5. The panels 11, 13, 17, 21 have respective second end flaps 51, 52, 53, 55, 57, 58 at a second marginal portion of the blank 3 such that the second end flaps are foldably connected to respective panels to close a second end 59 of the carton. As shown in FIG. 1, the bottom end flaps 41, 42 are foldably connected to the bottom panel 11 at a longitudinal fold line 61, the side end flap 43 is foldably connected to the first side panel 13 at a longitudinal fold line 63, the side end flap 45 is foldably connected to the second side panel 17 at a longitudinal fold line 65, and the top end flaps 47, 48 are foldably connected to the first top panel 21 at a longitudinal fold line 67. In one embodiment, the bottom panel 11 includes a first oblique edge 69 extending between the fold lines 61, 63 and a second oblique edge 71 between the fold lines 61, 65. Similarly, the first top panel 21 includes a first oblique edge 73 between the fold lines 63, 67 and a second oblique edge 75 between the fold line 67 and the lateral edge 76 of the blank 3. As shown in FIG. 1, the side end flap 43 includes a base portion 77 foldably connected to the first side panel 13 at fold line 63, an intermediate portion 79 foldably connected to the base portion at a longitudinal fold line 81, and a distal portion 83 foldably connected to the intermediate portion at a longitudinal fold line 85. In one embodiment, the fold line 85 includes a cut 86 extending between two portions of the fold line. Also, the distal portion 83 includes a notch 88 in an outer edge 90 of the side end flap 43. The side end flap 45 includes a base portion 122 foldably connected to the second side panel 17 at the fold line 65 and a distal portion 124 foldably connected to the base portion at a longitudinal fold line 126. In the illustrated embodiment, the second top panel 25 is free from first or second end flaps, but the second top panel could be otherwise shaped, arranged, and/or configured without departing from the disclosure.

As shown in FIG. 1, the second marginal portion of the blank 3 is a mirror image of the first marginal portion so that the second end flaps 51, 52, 53, 55, 57, 58 are shaped to have identical features as the first end flaps 41, 42, 43, 45, 47, 48. As such, the second end flaps 51, 52, 53, 55, 57, 58 are foldably connected to a respective panel 11, 13, 17, 21 at a respective fold line 91, 93, 95, 97. The bottom panel 11 has first and second oblique edges 99, 101 at the second marginal portion of the blank 3, and the first top panel 21 has first and second oblique edges 103, 105 at the second marginal portion of the blank. The side end flap 53 at the second marginal portion of the blank 3 has a base portion 107 foldably connected to the first side panel 13 at the longitudinal fold line 93, a intermediate portion 109 foldably connected to the base portion at a longitudinal fold line 111, and a distal portion 113 foldably connected to the intermediate portion 109 at a longitudinal fold line 115 that includes a cut 116. The distal portion 113 of the side end flap 53 includes a notch 118 in a peripheral edge 120 of the side end flap 53. As shown in FIG. 1, the side end flap 55 includes a base portion 132 foldably connected to the second side panel 17 at the fold line 95 and a distal portion 134 foldably connected to the base portion 132 at a longitudinal fold line 136. The first end flaps 41, 42, 43, 45, 47, 48 and the second end flaps 51, 52, 53, 55, 57 could be otherwise shaped, arranged, and/or configured without departing from the disclosure.

Figure 2:
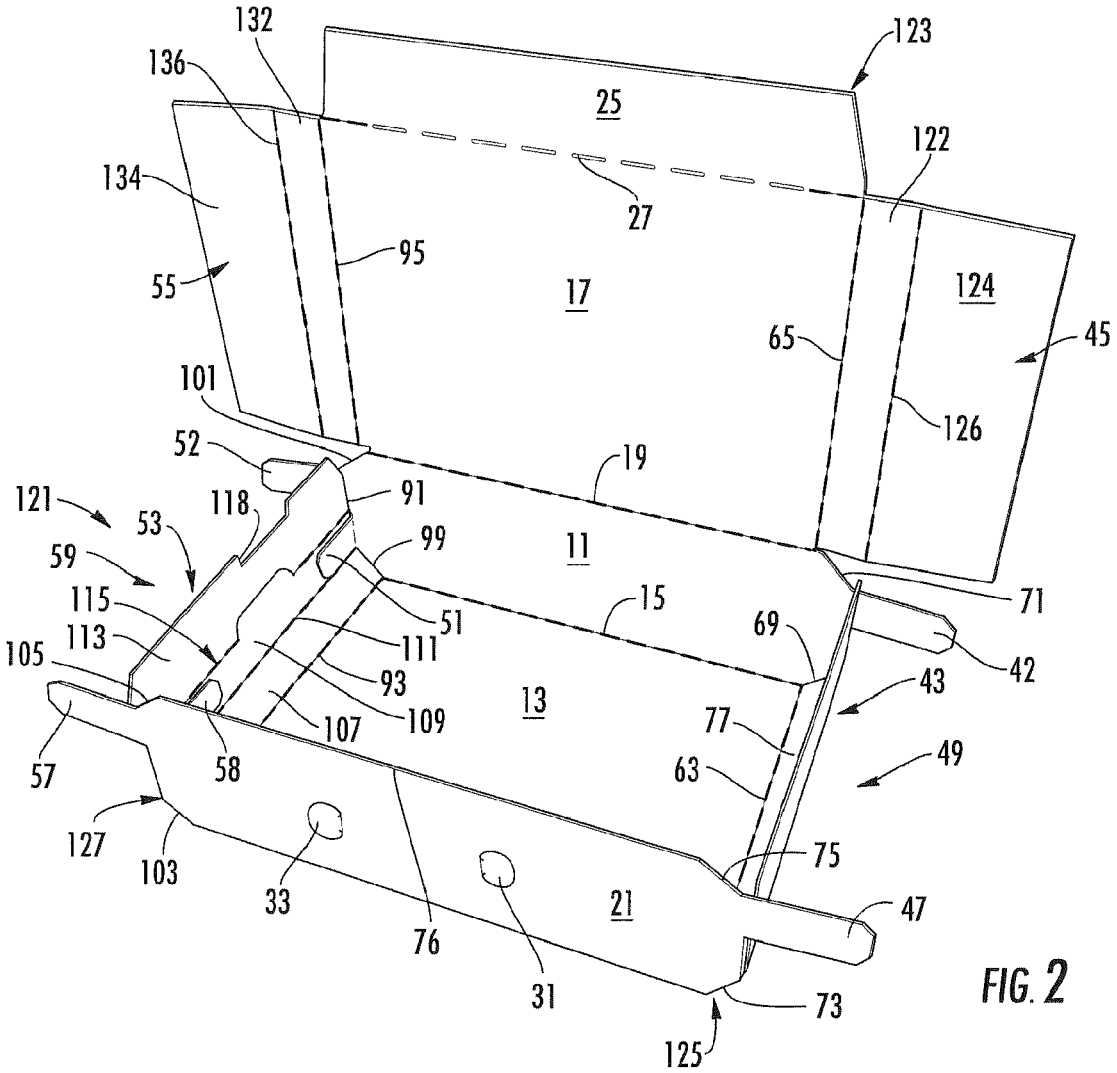
FIG. 2 is a perspective view of the carton in a partly assembled configuration in accordance with the first embodiment of the disclosure.

FIGS. 2-7 show one exemplary method of forming the blank 3 into the carton 5. In one embodiment, the first top panel 21, the bottom panel 11, and the side end flaps 43, 53 are upwardly folded relative to the first side panel 13 at respective fold lines 15, 23, 63, 93 to form a tray 121. The end flaps 41, 51 connected to the bottom panel 11 are inwardly folded at respective fold lines 61, 91 and positioned to be in face-to-face contact and adhered to a respective side end flap 43, 53. As shown in FIG. 2, the base portions 77, 107 of respective side end flaps 43, 53 is angled or positioned to be oblique relative to the first side panel 13, with the intermediate portions 79, 109 and distal portions 83, 113, positioned to be generally perpendicular to the first side panel 13. As shown in FIG. 2, the end flaps 51, 58 are adhered in face-to-face contact with the intermediate portion 109 of the end flap 53 and the end flaps 41, 48 are adhered in face-to-face contact with the intermediate portion 79 of the end flap 43. The oblique base portions 77, 107 of the end flaps 43, 53 conform to respective oblique edges 69, 73, 99, 103 of the bottom panel 11 and the first top panel 21 to form respective angled corners 125, 127 at the ends 49, 59 of the carton 5. In one embodiment, the second side panel 17, the second top panel 25, and the end flaps 45, 55 form a lid 123 that is foldably connected to the tray 121 at the fold line 19.

Figure 3:
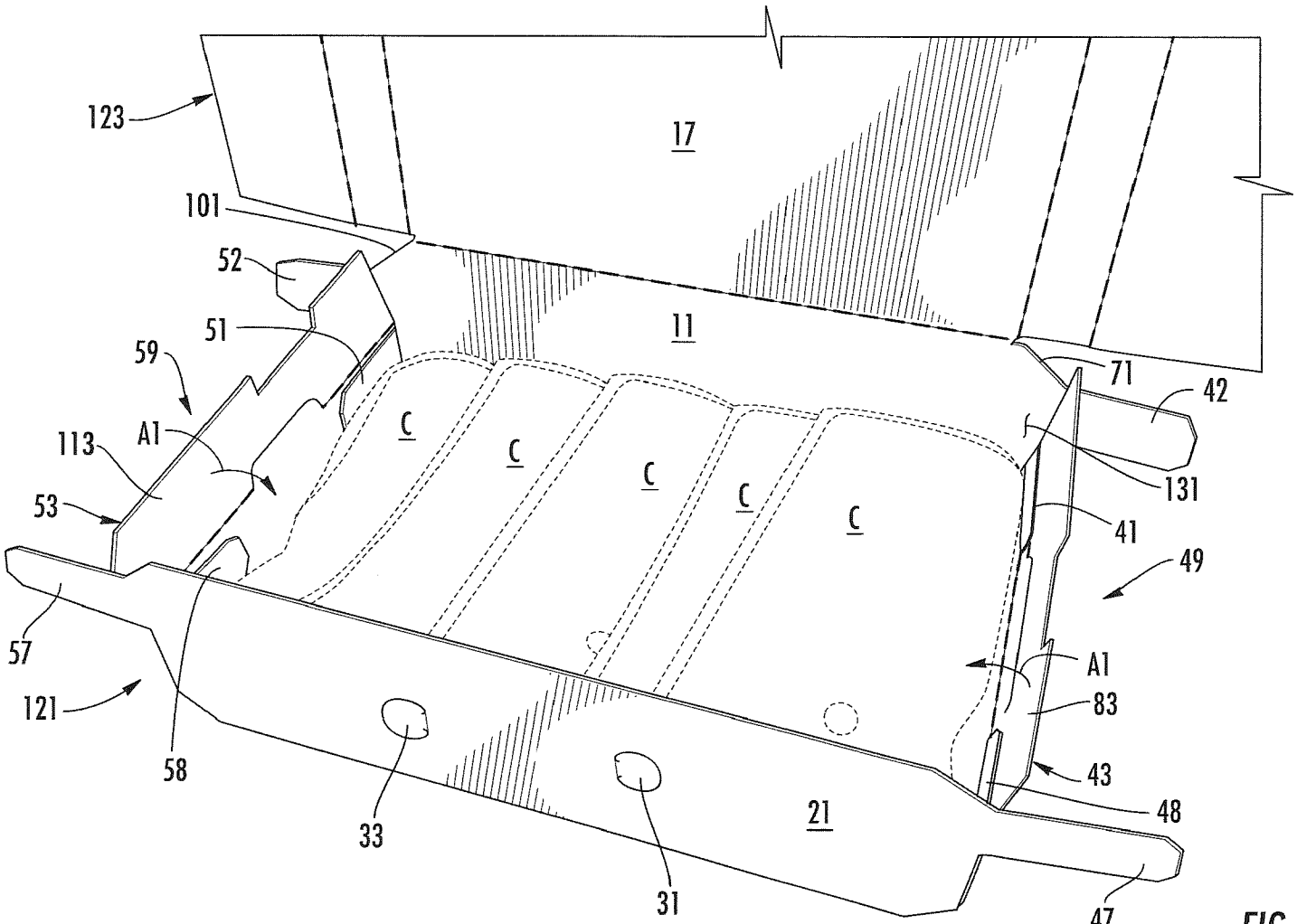
FIG. 3 is a perspective view of the carton in a further assembled configuration with articles placed in the interior of the carton in accordance with the first embodiment of the disclosure.
Figure 4:
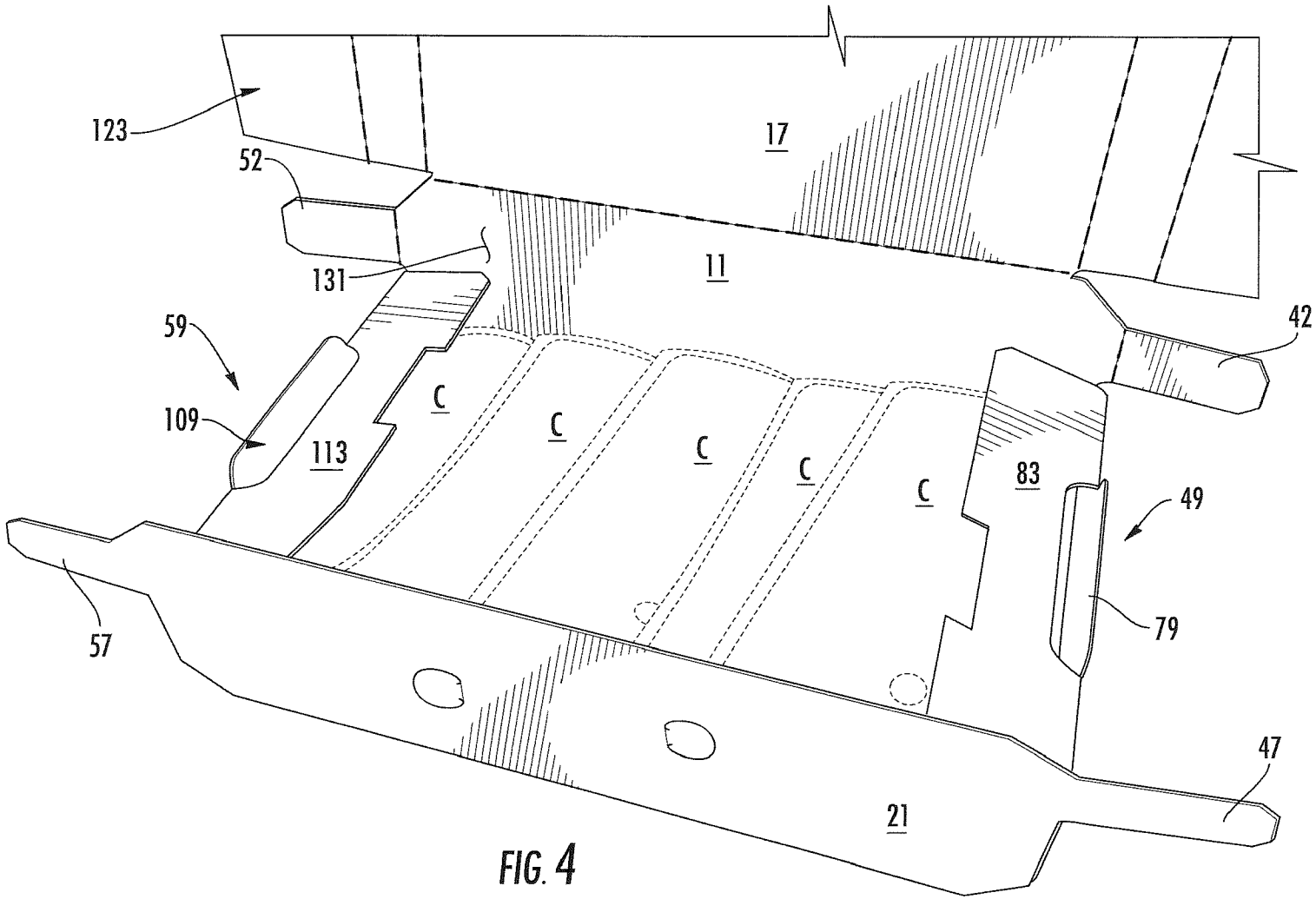
FIG. 4 is a perspective view of the carton in a further assembled configuration with articles placed in the interior of the carton and with distal portions of end flaps being positioned over a first layer of articles in accordance with the first embodiment of the disclosure.
Figure 5:
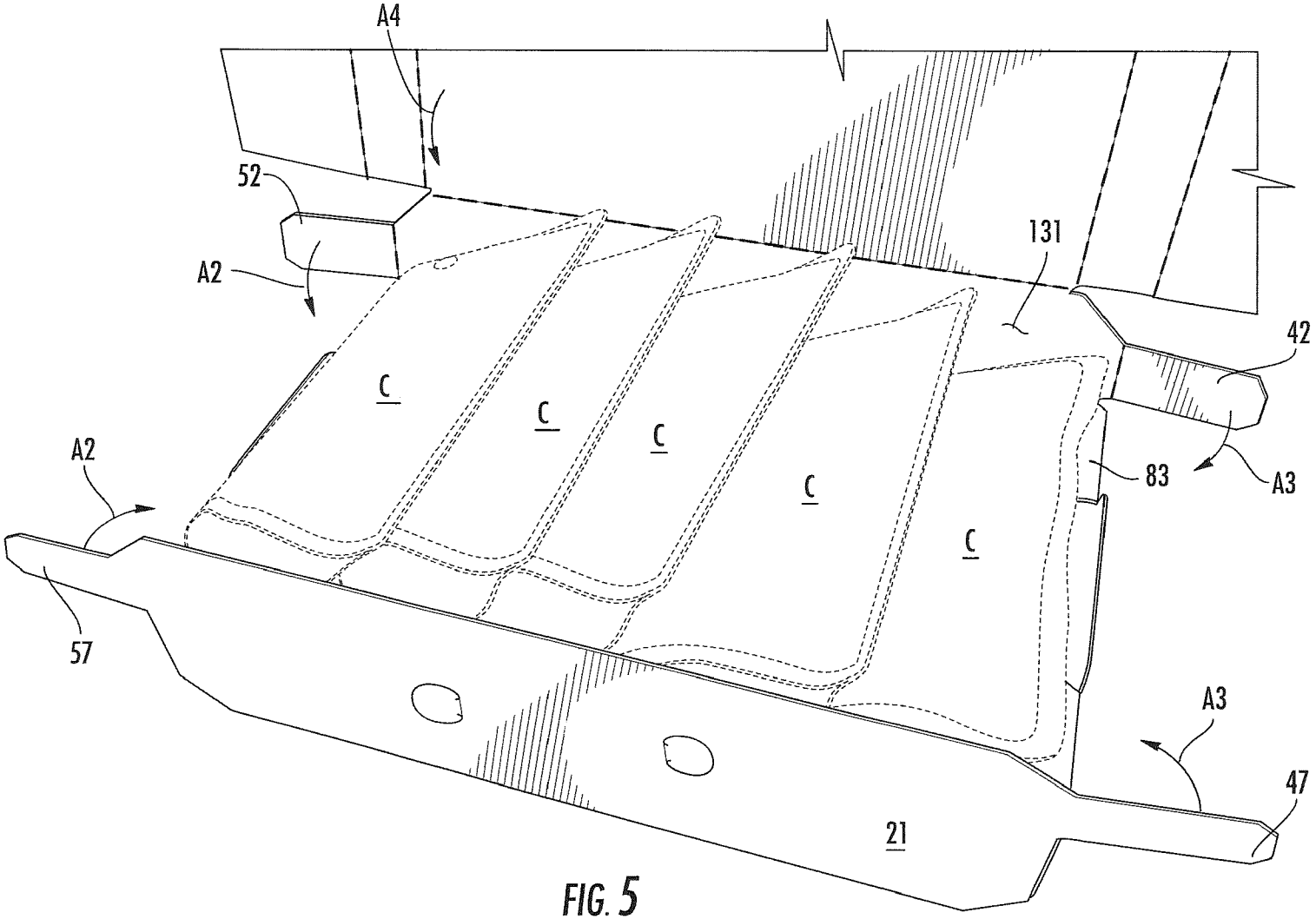
FIG. 5 is a perspective view of the carton in a further assembled configuration with articles placed in the interior of the carton and with distal portions of end flaps being positioned between a first layer and a second layer of articles in accordance with the first embodiment of the disclosure.

As shown in FIG. 3, a first layer of five containers C are loaded in the interior space 131 of the tray 121. In one embodiment, the first layer of containers C is supported on the first side panel 13. After loading the first layer of containers C, the distal portions 83, 113 of the side end flaps 43, 53 are downwardly folded in the direction of arrows A1 (FIG. 3) to the position shown in FIG. 4 wherein the distal portions overlay a portion of the containers C located adjacent the ends 49, 59. After downwardly folding the distal portions 83, 113 of the end flaps 43, 53, a second layer of five containers C is placed in the interior space on top of the first layer of containers (FIGS. 5 and 6). As shown in FIG. 5, the two containers C in the second layer that are adjacent the ends 49, 59 of the carton are partially supported by the downwardly folded distal portions 83, 113 of the end flaps 43, 53 so that the distal portions are positioned between the containers from each layer that are adjacent the ends of the carton. As shown in FIG. 7, the end flaps 42, 47 at the first end 49 and the end flaps 57, 52 at the second end 59 are inwardly folded in the direction of arrows A2, A3 (FIG. 5) to partially close the respective end and contain the second layer of containers C in the interior space 131. In the illustrated embodiment, two layers of five containers C are placed in the interior space so that ten containers are contained in the carton 5, but other quantities and arrangements of containers can be loaded in the carton 5 without departing from the disclosure. Further, the containers C can be loaded by other methods or steps. After the containers C are loaded in the tray 121, the lid 123 is downwardly folded relative to the tray 121 at fold line 19 (and in the direction of arrow A4 in FIG. 5) so that the second side panel 17 closes the interior space 131 of the tray. In one embodiment, the edge of the end flaps 45, 55 are downwardly folded to close the ends 49, 59 of the carton and the base portions 122, 132 of the end flaps conform to a respective pair of oblique edges 71, 75 and 101, 105. The oblique base portions 122, 132 of the end flaps 45, 55 are at an oblique angle relative to the distal portions 124, 134 of the end flaps 45, 55 and form respective angled corners 135, 137 at the ends 49, 59. In this way, the carton 5 comprises angled corners 125, 135 at the first end 49 and angled corners 127, 137 at the second end 59. The distal portions 124, 134 of the end flaps 45, 55 of the lid 123 can be adhesively attached to the intermediate portions 79, 109 of the end flaps 43, 53 and the end flaps 42, 47, 52, 57 by an adhesive such as glue. The second top panel 25 can be secured to the first top panel 21 by glue. The carton 5 could be formed by other steps or forming methods without departing from the disclosure.

In one embodiment, the distal portions 83, 113 of the end flaps 43, 53 that are located between adjacent layers of containers near the ends 49, 59 of the carton are reinforcement features that provide an internal structural member that increases the strength of the carton and increases the resistance to crushing of the carton when the cartons are stacked on top of each other. Also, the angled corners 125, 135, 127, 137 at respective ends 49, 59 can increase the strength of the carton 5 and provide further reinforcement. Because of the increased strength resulting from the internal structural members 83, 113, the carton 5 and blank 3 can be manufactured from lighter or thinner material thus saving manufacturing costs. The carton 5 could have other features without departing from the scope of the disclosure.

Figure 9:
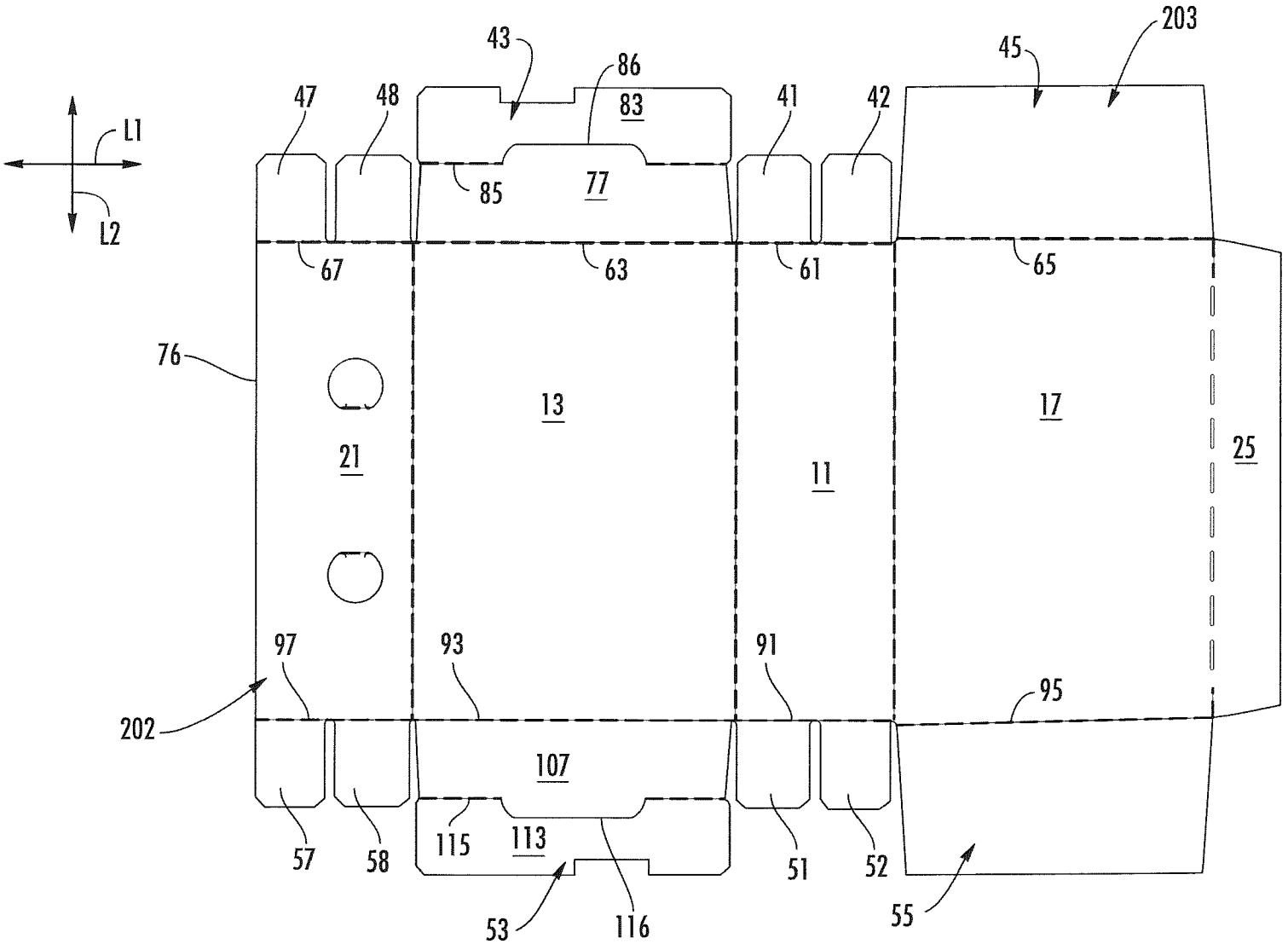
FIG. 9 is an exterior plan view of a carton blank used to form a carton in accordance with a second embodiment of the disclosure.
Figure 10:
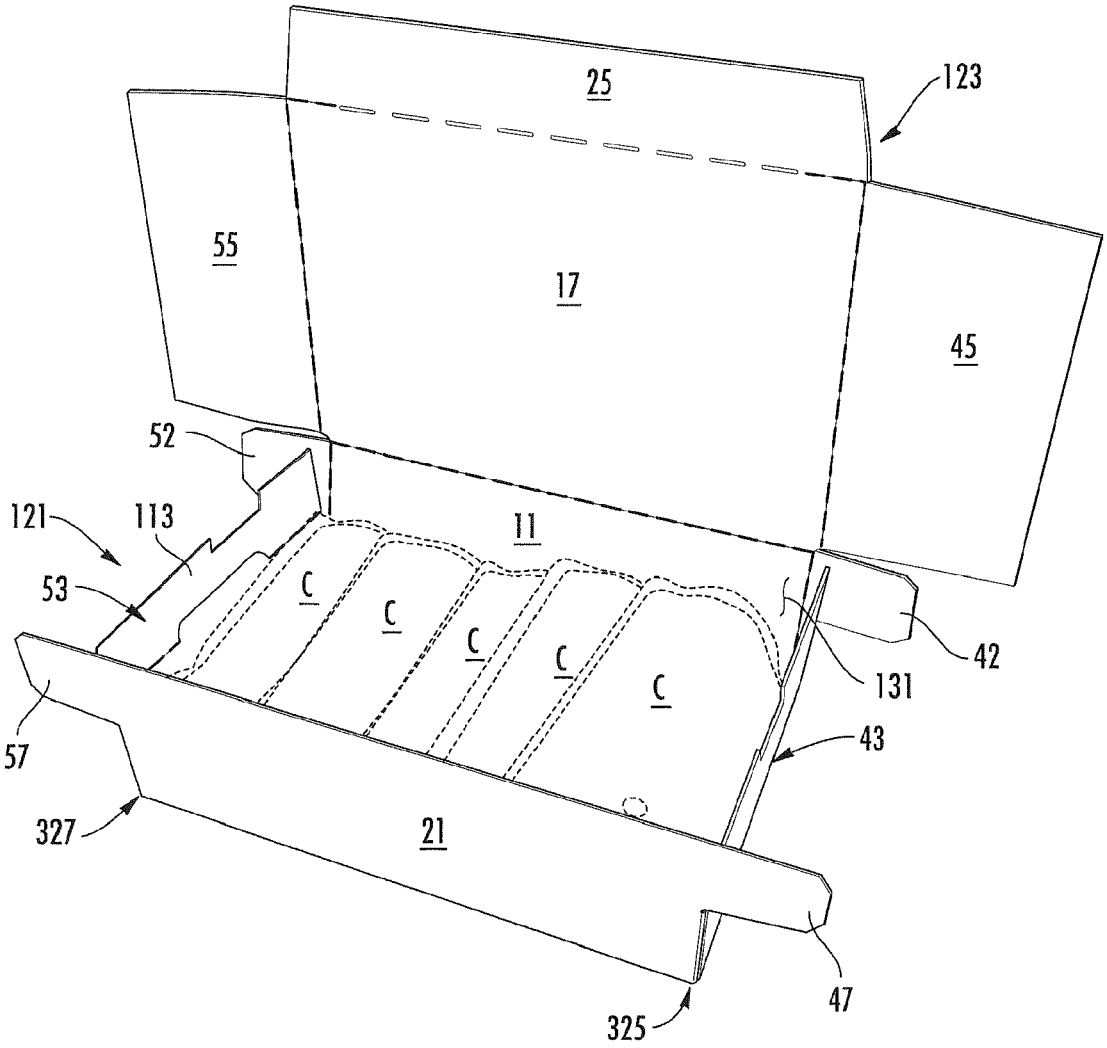
FIG. 10 is a perspective view of the carton in a partially assembled configuration with articles placed in the interior of the carton in accordance with the second embodiment of the disclosure.
Figure 11:
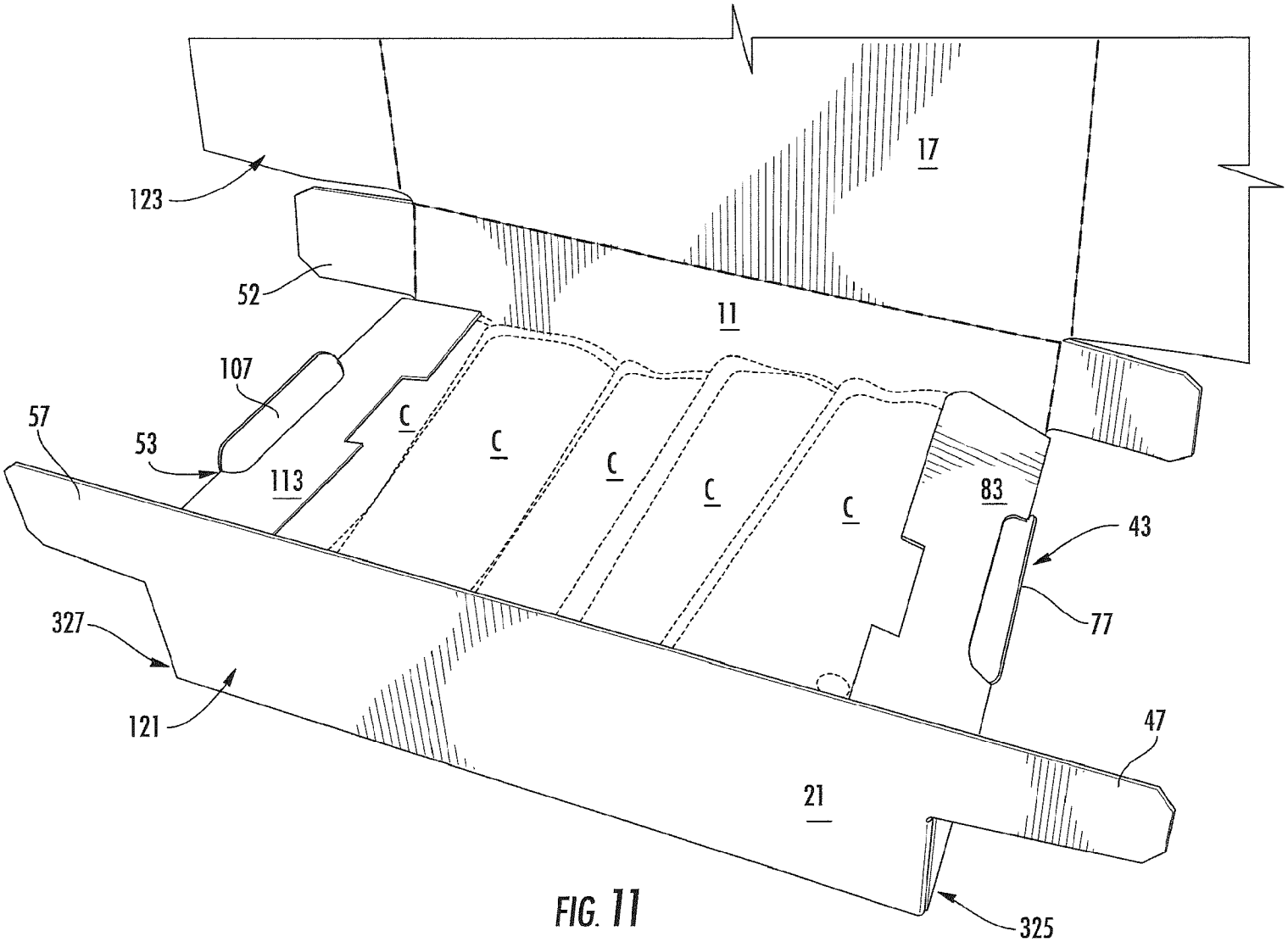
FIG. 11 is a perspective view of the carton in a further assembled configuration with articles placed in the interior of the carton and with distal portions of end flaps being positioned over a first layer of articles in accordance with the second embodiment of the disclosure.
Figure 12:
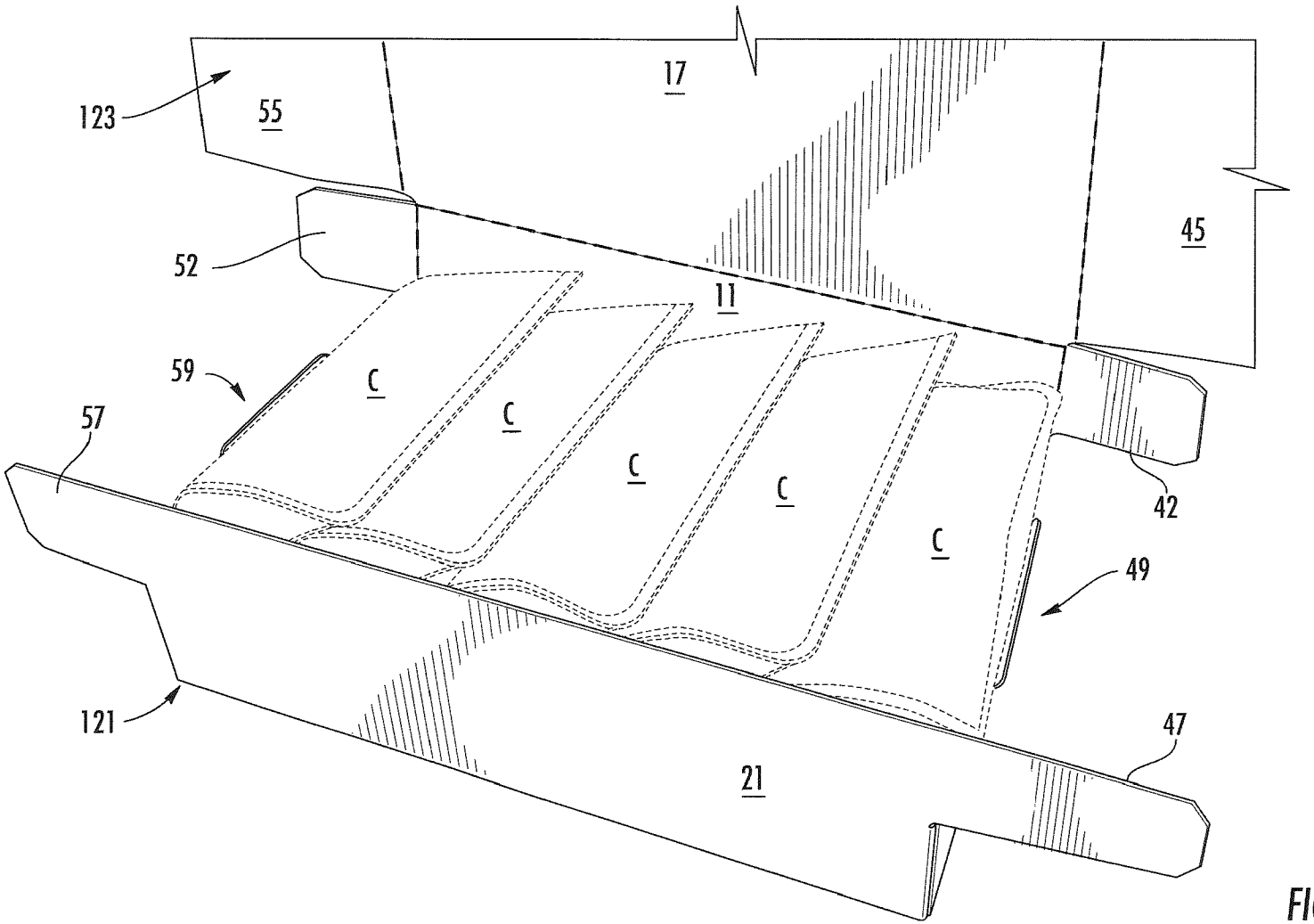
FIG. 12 is a perspective view of the carton in a further assembled configuration with articles placed in the interior of the carton and with distal portions of end flaps being positioned between a first layer and a second layer of articles in accordance with the second embodiment of the disclosure.
Figure 13:
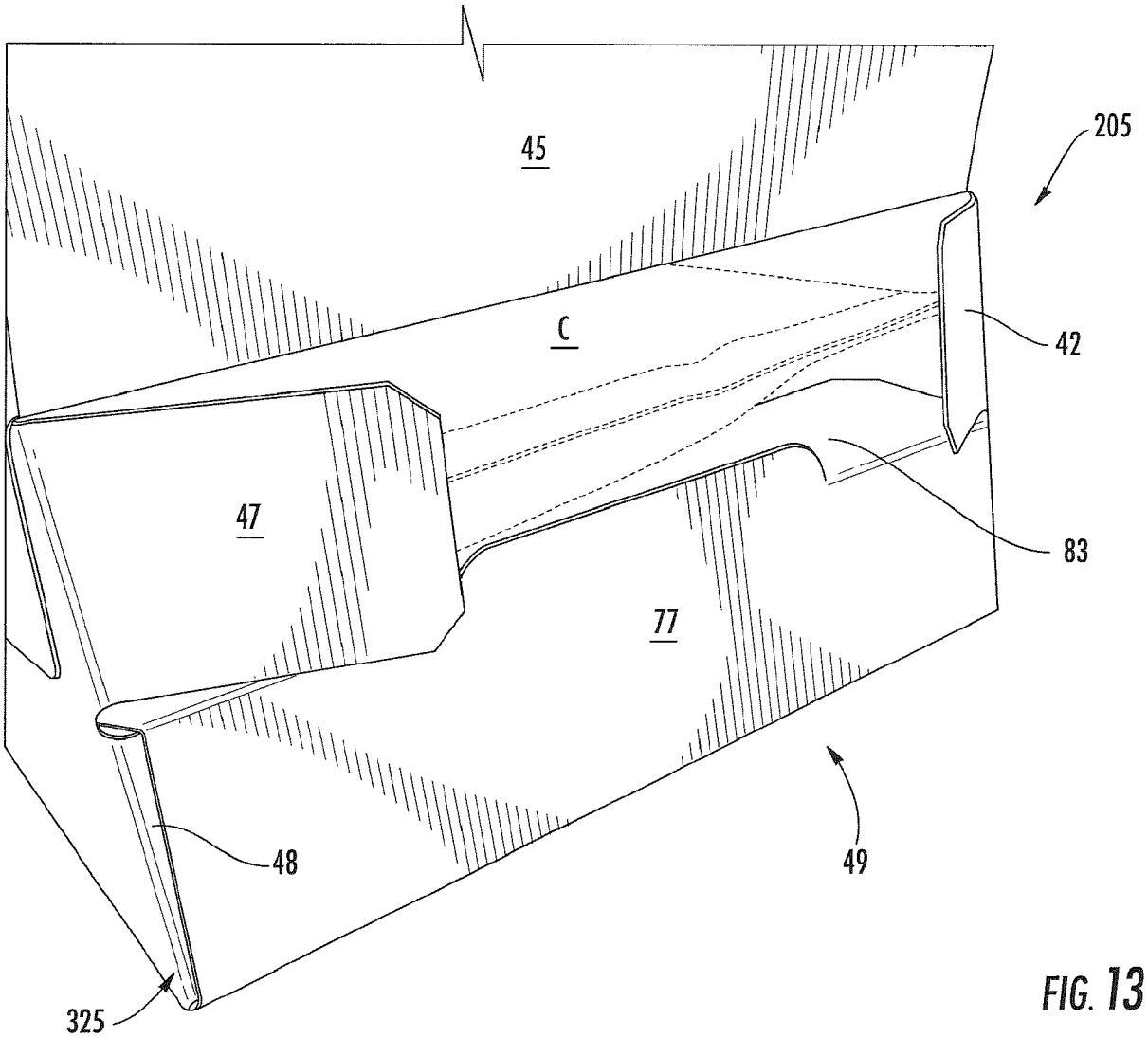
FIG. 13 is a close-up view of an end of the partially assembled carton having reinforcement features in accordance with the second embodiment of the disclosure.
Figure 14:
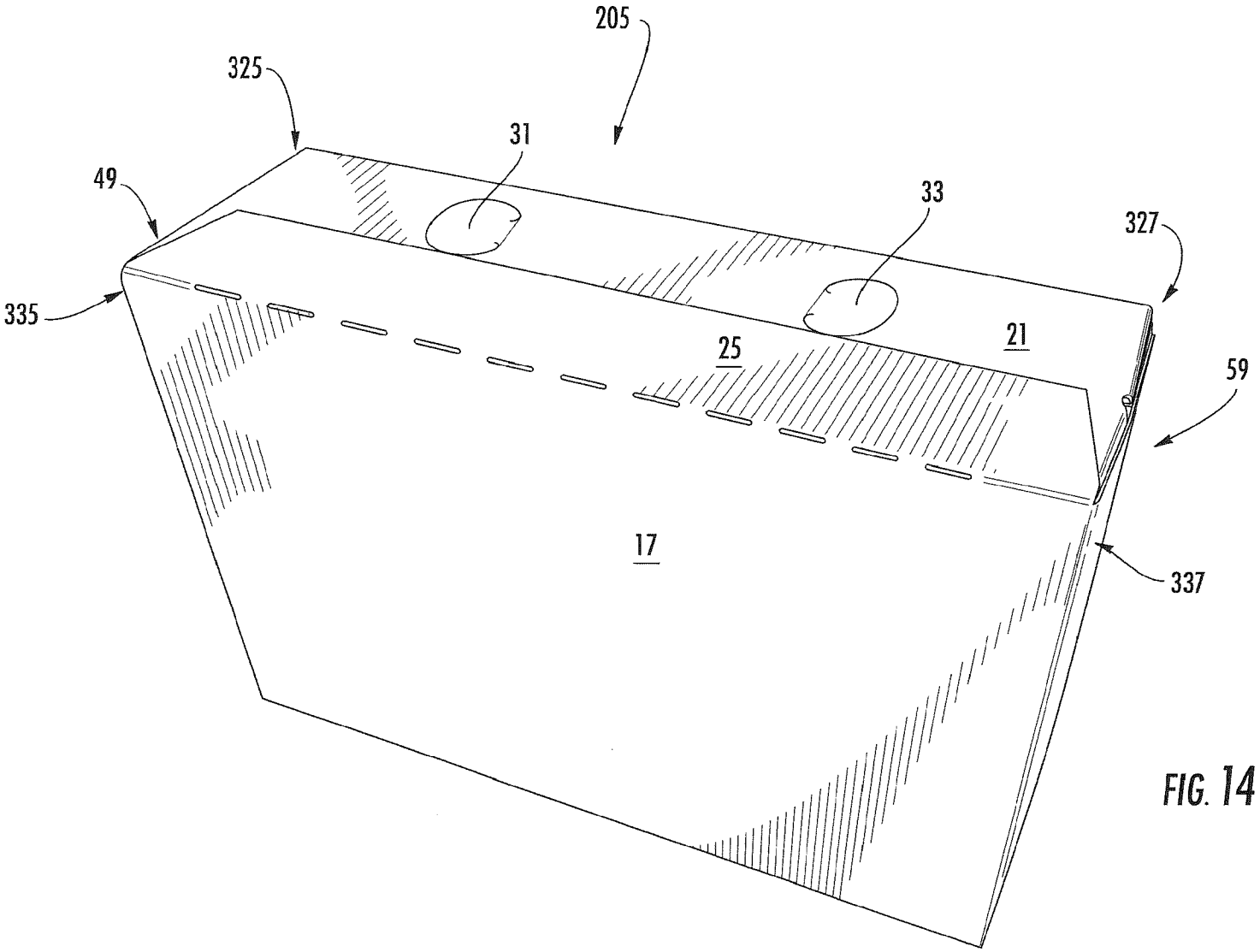
FIG. 14 is a perspective view of the assembled carton in accordance with the second embodiment of the disclosure.
Figure 15:
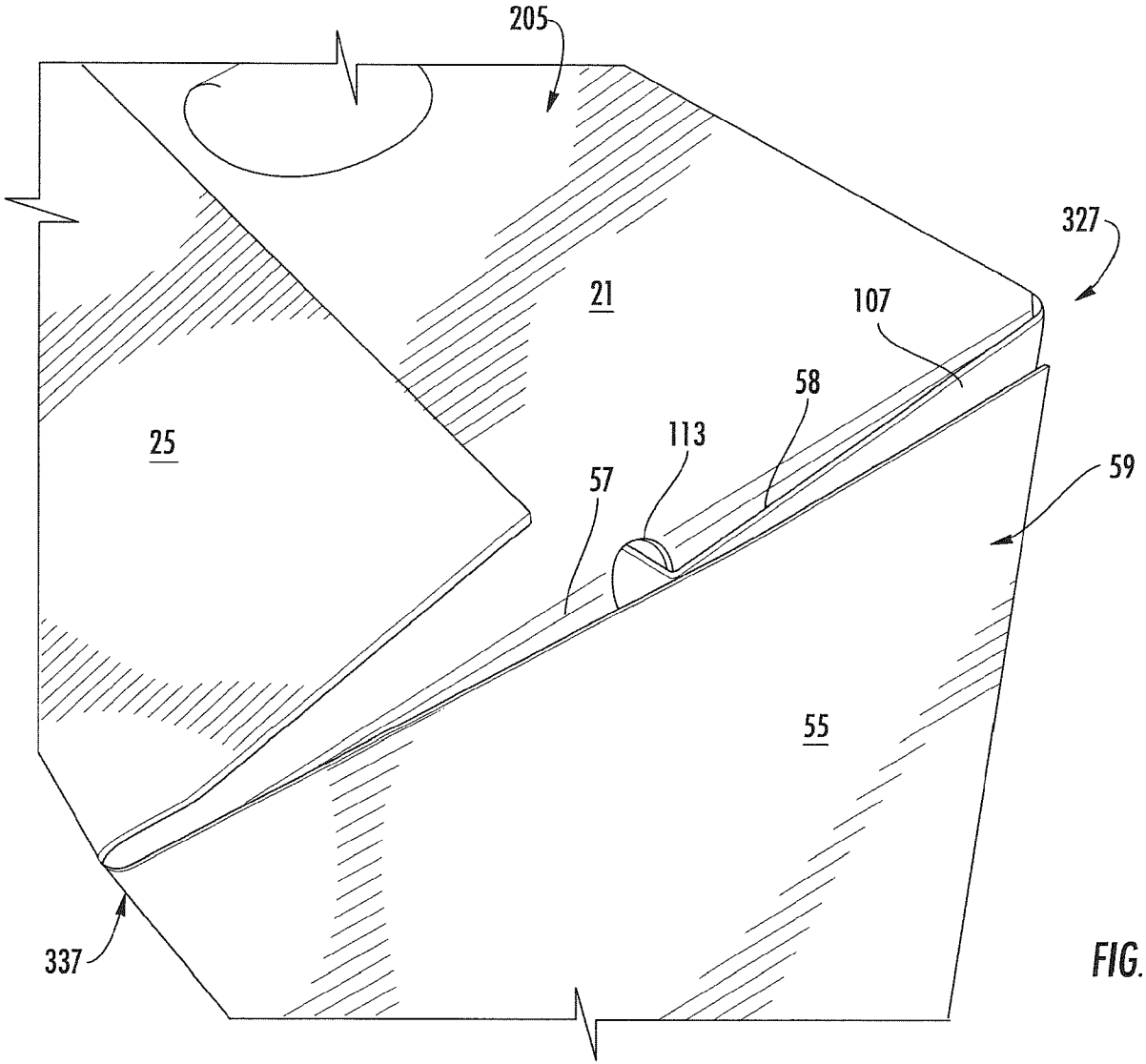
FIG. 15 is a close-up view of an end of the assembled carton having reinforcement features in accordance with the second embodiment of the disclosure.

FIG. 9 illustrates an exterior surface 202 of a blank 203 for forming a carton 205 (FIGS. 14-15) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 9-15, the blank 203 includes features for forming the carton 205 that has square or orthogonal corners 325, 335 at the first end 49 and square or orthogonal corners 327, 337 at the second end 59 of the carton. As shown in FIG. 9, the end flaps 43, 53 comprise base portions 77, 107 and distal portions 83, 113, such that the intermediate portions 79, 109 of the first embodiment have been eliminated so that the base portions 77, 107 are positioned to be generally perpendicular to the side panels 13, 17 when the ends 49, 59 of the carton 205 are closed. Similarly, the end flaps 45, 55 are free of any fold lines so that the end flaps 45, 55 are folded to be generally perpendicular to the side panels 13, 17 and overlap the base portions 77, 107 of the end flaps 43, 43 when the ends 49, 59 of the carton 205 are closed. To facilitate the formation of the square or orthogonal corners 325, 335, 327, 337, the fold lines 61, 63, 65, 67 of the blank 203 are generally aligned or collinear, such that each of the fold lines are spaced from the longitudinal centerline CL of the blank by approximately the same distance D. Also, as shown in FIG. 9, the fold lines 91, 93, 95, 97 are generally aligned and collinear, such that each of the fold lines is spaced from the longitudinal centerline CL of the blank by approximately the same distance D. The blank 203 and/or carton 205 could have other features without departing from the disclosure.

As shown in FIGS. 10-15, the carton 205 can be formed in a similar manner as the carton 5 of the first embodiment, with the distal portions 83, 113 of the end flaps providing reinforcement features that strengthen the carton. The carton 205 can be formed by other methods and the carton can have other features without departing from the disclosure.

In general, the blanks described herein may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, the carton comprising:

a plurality of panels that extend at least partially around an interior of the carton, the plurality of panels comprising at least one top panel, a first side panel, a second side panel, and a bottom panel;

the plurality of articles being in the interior of the carton and comprising a first layer of articles supported by the first side panel and a second layer of articles on top of the first layer of articles and adjacent the second side panel;

a plurality of end flaps foldably connected to respective panels of the plurality of panels for closing an end of the carton, the plurality of end flaps comprising a top end flap foldably connected to the at least one top panel, a bottom end flap foldably connected to the bottom panel, a first side end flap foldably connected to the first side panel, and a second side end flap foldably connected to the second side panel, the top end flap and the bottom end flap being in face-to-face contact with an interior surface of the first side end flap, and the second side end flap overlapping at least a portion of the first side end flap to close the end of the carton, the first side end flap has reinforcement features for increasing the strength of the carton, the reinforcement features comprise a distal portion of the first side end flap that is positioned between a first article of the first layer of articles and a second article of the second layer of articles, the distal portion being generally parallel to the first side panel.

2. The carton of claim 1, wherein the first side end flap comprises a base portion foldably connected to the first side panel.

3. The carton of claim 2, wherein the first side end flap comprises an intermediate portion foldably connected to the base portion and the distal portion.

4. The carton of claim 3, wherein the base portion is positioned at an oblique angle relative to the intermediate portion.

5. The carton of claim 4, wherein the distal portion is positioned generally perpendicular to the intermediate portion.

6. The carton of claim 5, wherein the distal portion is foldably connected to the intermediate portion at a line of weakening, the line of weakening comprises two fold lines and a cut extending between the fold lines.

7. The carton of claim 2, wherein the distal portion is positioned generally perpendicular to the base portion.

8. The carton of claim 7, wherein the distal portion is foldably connected to the base portion at a line of weakening, the line of weakening comprises two fold lines and a cut extending between the fold lines.

9. The carton of claim 2, wherein the top end flap is a first top end flap and the plurality of end flaps comprises a second top end flap foldably connected to the at least one top panel, and the bottom end flap is a first bottom end flap and the plurality of end flaps comprises a second bottom end flap foldably connected to the bottom panel.

10. The carton of claim 9, wherein the first top end flap and the first bottom end flap are in face-to-face contact with the interior surface of the first side end flap.

11. The carton of claim 10, wherein the base portion is positioned generally perpendicular to the first side panel and forms a corner of the carton that is orthogonal relative to the first side panel.

12. The carton of claim 9, wherein the first side end flap comprises an intermediate portion foldably connected to the base portion and the distal portion and the first top end flap and the first bottom end flap are in face-to-face contact with an interior surface of the intermediate portion.

13. The carton of claim 12, wherein the at least one top panel comprises a first oblique edge, the bottom panel comprises a second oblique edge, and the base portion of the first side end flap conforms to the first oblique edge and the second oblique edge and forms a corner of the carton that is oblique relative to the first side panel.

14. The carton of claim 9, wherein the second top end flap and the second bottom end flap are in face-to-face contact with an interior surface of the second side end flap, and the first top end flap and the first bottom end flap are in face-to-face contact with the interior surface of the first side end flap.

15. The carton of claim 14, wherein the second side end flap is in face-to-face contact with at least a portion of an exterior surface of the first side end flap.

16. The carton of claim 1, wherein the second side end flap is in face-to-face contact with at least a portion of an exterior surface of the first side end flap.

17. A blank for forming a carton for carrying a plurality of articles arranged in a first layer of articles and a second layer of articles on top of the first layer of articles, the blank comprising:

a plurality of panels comprising at least one top panel, a first side panel, a second side panel, and a bottom panel, the first side panel supporting the first layer of articles in an interior of the carton formed from the blank and the second side panel being adjacent the second layer of articles in the carton formed from the blank;

a plurality of end flaps foldably connected to a respective panel of the plurality of panels for closing an end of the carton formed from the blank, the plurality of end flaps comprising a top end flap foldably connected to the at least one top panel, a bottom end flap foldably connected to the bottom panel, a first side end flap foldably connected to the first side panel, and a second side end flap foldably connected the second side panel, the top end flap and the bottom end flap are for being in face-to-face contact with an interior surface of the first side end flap, and the second side end flap is for overlapping at least a portion of the first side end flap to close the end of the carton formed from the blank, the first side end flap has reinforcement features for increasing the strength of the carton, the reinforcement features comprising a distal portion of the first side end flap that is for being positioned between a first article of the first layer of articles and a second article of the second layer of articles, the distal portion being generally parallel to the first side panel when the carton is formed from the blank.

18. The blank of claim 17, wherein the first side end flap comprises a base portion foldably connected to the first side panel.

19. The blank of claim 18, wherein the first side end flap comprises an intermediate portion foldably connected to the base portion and the distal portion.

20. The blank of claim 19, wherein the base portion is positioned at an oblique angle relative to the intermediate portion when the carton is formed from the blank.

21. The blank of claim 20, wherein the distal portion is positioned generally perpendicular to the intermediate portion when the carton is formed from the blank.

22. The blank of claim 21, wherein the distal portion is foldably connected to the intermediate portion at a line of weakening, the line of weakening comprises two fold lines and a cut extending between the fold lines.

23. The blank of claim 18, wherein the distal portion is positioned generally perpendicular to the base portion when the carton is formed from the blank.

24. The blank of claim 23, wherein the distal portion is foldably connected to the base portion at a line of weakening, the line of weakening comprises two fold lines and a cut extending between the fold lines.

25. The blank of claim 18, wherein the top end flap is a first top end flap and the plurality of end flaps comprises a second top end flap foldably connected to the at least one top panel, and the bottom end flap is a first bottom end flap and the plurality of end flaps comprises a second bottom end flap foldably connected to the bottom panel.

26. The blank of claim 25, wherein the first top end flap and the first bottom end flap are configured to be in face-to-face contact with the interior surface of the first side end flap when the carton is formed from the blank.

27. The blank of claim 26, wherein the base portion is positioned generally perpendicular to the first side panel and forms a corner of the carton that is orthogonal relative to the first side panel when the carton is formed from the blank.

28. The blank of claim 25, wherein the first side end flap comprises an intermediate portion foldably connected to the base portion and the distal portion and the first top end flap and the first bottom end flap are configured to be in face-to-face contact with an interior surface of the intermediate portion when the carton is formed from the blank.

29. The blank of claim 28, wherein the at least one top panel comprises a first oblique edge, the bottom panel comprises a second oblique edge, and the base portion of the first side end flap conforms to the first oblique edge and the second oblique edge and forms a corner of the carton that is oblique relative to the first side panel when the carton is formed from the blank.

30. A method of forming a carton for carrying a plurality of articles, the method comprising:

obtaining a blank comprising a plurality of panels comprising at least one top panel, a first side panel, a second side panel, and a bottom panel, a plurality of end flaps each foldably connected to a respective panel of the plurality of panels, the plurality of end flaps comprising a top end flap foldably connected to the at least one top panel, a bottom end flap foldably connected to the bottom panel, a first side end flap foldably connected to the first side panel, and a second side end flap foldably connected to the second side panel, the first side end flap has reinforcement features for increasing the strength of the carton, the reinforcement features comprising a distal portion of the first side end flap;

positioning the plurality of panels to form an interior of the carton;

loading the plurality of articles in the interior of the carton and arranging a first layer of the plurality of articles supported by the first side panel and a second layer of articles on top of the first layer of articles;

positioning the second side panel to be adjacent the second layer of articles;

closing an end of the carton by at least partially overlapping the plurality of end flaps, the closing the end comprises positioning the top end flap and the bottom end flap in face-to-face contact with an interior surface of the first side end flap, and positioning the second side end flap to overlap at least a portion of the first side end flap; and positioning the first side end flap to increase the strength of the carton, the positioning the first side end flap comprising positioning the distal portion between a first article of the first layer of articles and a second article of the second layer of articles, the distal portion being generally parallel to the first side panel.

31. The method of claim 30, wherein the first side end flap comprises a base portion foldably connected to the first side panel.

32. The method of claim 31, wherein the first side end flap comprises an intermediate portion foldably connected to the base portion and the distal portion.

33. The method of claim 32, wherein the positioning the first side end flap comprises positioning the base portion at an oblique angle relative to the intermediate portion.

34. The method of claim 33, wherein the positioning the first side end flap comprises positioning the distal portion to be generally perpendicular to the intermediate portion.

35. The method of claim 34, wherein the distal portion is foldably connected to the intermediate portion at a line of weakening, the line of weakening comprises two fold lines and a cut extending between the fold lines.

36. The method of claim 31, wherein the positioning the first side end flap comprises positioning the distal portion to be generally perpendicular to the base portion.

37. The method of claim 36, wherein the distal portion is foldably connected to the base portion at a line of weakening, the line of weakening comprises two fold lines and a cut extending between the fold lines.

38. The method of claim 31, wherein the top end flap is a first top end flap and the plurality of end flaps comprises a second top end flap foldably connected to the first top panel, and the bottom end flap is a first bottom end flap and the plurality of end flaps comprises a second bottom end flap foldably connected to the bottom panel.

39. The method of claim 38, wherein the at least partially overlapping the plurality of end flaps comprises positioning the first top end flap and the first bottom end flap to be in face-to-face contact with the interior surface of the first side end flap.

40. The method of claim 39, wherein the positioning the plurality of panels comprises positioning the base portion to be generally perpendicular to the first side panel and forming a corner of the carton that is orthogonal relative to the first side panel.

41. The method of claim 38, wherein the first side end flap comprises an intermediate portion foldably connected to the base portion and the distal portion, and the at least partially overlapping the plurality of end flaps comprises positioning the first top end flap and the first bottom end flap to be in face-to-face contact with an interior surface of the intermediate portion.

42. The method of claim 41, wherein the at least one top panel comprises a first oblique edge, the bottom panel comprises a second oblique edge, and the positioning the plurality of panels comprises positioning the base portion of the first side end flap to conform to the first oblique edge and the second oblique edge and forming a corner of the carton that is oblique relative to the first side panel.

43. The method of claim 38, wherein, the closing the end comprises positioning the second top end flap and the second bottom end flap in face-to-face contact with an interior surface of the second side end flap, and positioning the first top end flap and the first bottom end flap in face-to-face contact with the interior surface of the first side end flap.

44. The method of claim 43, wherein the closing the end comprises positioning the second side end flap in face-to-face contact with at least a portion of an exterior surface of the first side end flap.

45. The method of claim 30, wherein the closing the end comprises positioning the second side end flap in face-to-face contact with at least a portion of an exterior surface of the first side end flap.

* * * * *